US005120049A

United States Patent [19]

Fischer

[11] Patent Number: 5,120,049

[45] Date of Patent: Jun. 9, 1992

[54] FOLDER APPARATUS

[75] Inventor: Emil Fischer, Oggersheim, Fed. Rep. of Germany

[73] Assignee: Albert-Frankenthal AG, Frankenthal, Fed. Rep. of Germany

[21] Appl. No.: 566,163

[22] Filed: Aug. 10, 1990

Related U.S. Application Data

[63] Continuation-in-part of Ser. No. 351,765, May 15, 1989, abandoned.

[30] Foreign Application Priority Data

May 26, 1988 [DE] Fed. Rep. of Germany ..... 3817804

[51] Int. Cl.[5] ..... B65H 29/20

[52] U.S. Cl. ..... 271/315; 271/187; 493/480

[58] Field of Search ..... 493/480; 271/187, 315

[56] References Cited

U.S. PATENT DOCUMENTS

| | | | |
|---|---|---|---|
| 3,119,609 | 1/1964 | Porter | 271/187 |
| 4,334,673 | 6/1982 | Clifton | 271/187 |
| 4,391,596 | 7/1983 | Fischer | 493/432 |
| 4,600,186 | 7/1986 | von Hein et al. | 271/187 |
| 4,629,174 | 12/1986 | Wakisaka | 271/187 |
| 4,715,594 | 12/1987 | Isobe et al. | 271/187 |
| 4,718,655 | 1/1988 | Okayama et al. | 271/187 |

*Primary Examiner*—Bruce M. Kisliuk
*Assistant Examiner*—Jack Lavinder
*Attorney, Agent, or Firm*—Edwin D. Schindler

[57] ABSTRACT

A folder apparatus is disclosed which is adapted for use with at least two adjacently arriving webs and having at least one fan wheel. The fan wheel is provided with a number of compartments delimited by guide disks to ensure, that in the case of different processing of the two or more webs, that all of the compartments therefor are used. The fan wheel of the folding apparatus is divided up into a number of laterally adjoining fan wheel sections, which number corresponds to the number of webs to be handled and able to be driven separately from each other by associated drive means.

15 Claims, 3 Drawing Sheets

FOLDER APPARATUS

CROSS-REFERENCE TO RELATED APPLICATION

This application is a continuation-in-part of application Ser. No. 07/351,765, filed May 15, 1989, now abandoned.

BACKGROUND OF THE INVENTION

The present invention relates to a folder apparatus for the processing of a plurality of webs and, more particularly, of two incoming webs, running side-by-side, comprising at least one fan wheel, which has a plurality of compartments delimited by lateral guide disks extending around the periphery.

Such a folder makes it possible, for example, for two adjacently placed incoming webs to be cut to the desired size of a page and to be processed independently of each other with the production of different types of product. It is, thus, possible for the products manufactured from one web to be folded without being collected and for them to be delivered by way of the fan wheel, whereas the products made from the other web are collected, folded and delivered via the fan wheel, which extends over the full width of the folder.

In arrangement known to the prior art, the fan wheel, which extends over the full working width of the folder, is subdivided and, accordingly, moves at the same peripheral speed along its full length. In the case of operation with different processing of the adjacently moving webs there is, therefore, a difference between the products along the length of the fan wheel compartments over the working width. For example, on the side charged with non-collected products, all compartments will be filled about the periphery, while on the side charged with collected products, only every n-th compartment will be occupied. When the products leave the fan wheel and pass onto the delivery belt running under the fan wheel in the form of two parallel streams of overlapped products, the pitch of the products on the belts may be different; something that may impair the delivery action and lead to problems for further processing. A particular disadvantage is the fact that the products produced side-by-side have to be taken up in the fan wheel at the same instant, even if they do not have the same weight. If this condition is not complied with, this will be a further source of inaccuracy later on.

In the relevant art, the term "folding apparatus" is clearly defined and understood for each skilled artisan. Each "folding apparatus" shows the same functional principle with respect to the facts which are relevant in connection with the present invention. Skilled persons in the relevant technical art differ between:

(a) "folding apparatus" which always has folding knives and jaws and is always positioned upstream of a roll printing plate; and, (b) "folding machine," which is not positioned upstream of a roll printing plant and has other folding elements.

SUMMARY OF THE INVENTION

Taking the foregoing state of the art as a starting point, it is an object of the present invention to provide an improved folder for web products of the aforesaid-mentioned type using mechanically simple and economical means so that, even when handling different types of products at different positions along the width of the folder, it is possible to avoid irregular charging of the compartments over the width of the folder.

In order to achieve the foregoing and other objects of the present invention, the fan wheel is divided up into laterally adjacent wheel sections, the number of such sections being equal to the number of adjacent webs to be processed, and which are able to be separately driven.

A subdivided fan wheel of this type completely precludes the shortcomings inherent in the prior art since each section of the fan wheel is always able to be driven at a speed which is so adapted to the type of product in question that, in each section, each compartment is charged with product. The overlapped streams of products formed on the delivery belt are, thus formed with the same pitch, this not only resulting in precise operation, but also simultaneously reducing the overlap distance.

A still further advantage of the present invention is to be seen in the fact that the individual sections of the fan wheel are able to be adjusted independently of each other in the peripheral direction. The peripheral setting of the individual sections of the fan wheel may, thus, be exactly adapted to the weight of the respective products.

Furthermore, the invention makes it possible to inactivate one of the wheel sections if the number of webs being processed is less than the maximum web number.

Additional features and advantages of the present invention are detailed hereinafter:

In accordance with one such further feature, the laterally adjacent fan wheel sections may have coaxial shaft sections bearinged on each other which, in the vicinity of the oppositely placed ends, are provided with drive means. This design leads to a very compact structure with a single, continuous central shaft which has interruptions. In this respect, despite the subdivision of the fan wheel, it is possible to take up the products which are produced from closely adjacent webs so that the products do not have any substantial clearance between them. It is an advantage in this respect if one of the respective shaft sections has a coaxial hole to receive a journal pin on the other shaft section in it. This ensures that the interlocking bearing means does not give rise to any axial spacing between the two shaft sections.

In accordance with yet a further development of the present invention, the lateral drive means each comprise a number of drive wheels with different diameters connected with the associated shaft section; such wheels cooperating with the associated input wheels of a multi-speed gearbox having an input wheel able to be coupled therewith. This feature facilitates rapid setting to the correct speed and, thus, makes the system easier to operate. The input wheels of the two multi-speed gearboxes may, in this respect, be able to be driven by means of a shaft stretching across the full width of the folder, this leading to a particularly simple structure and, in the case of processing similar types of product during the processing of all webs or of a single web extending across the full width of the machine facilitating synchronizing the fan wheel sections arranged adjacent to each other.

It is an advantage if the drive wheels are mounted on a carrier which includes the associated shaft section and which is coupled via helical gearing with a bushing which is able to be slid in the axial direction onto the associated shaft section. By axial shifting of the bushing, it is possible to cause peripheral adjustment of the associated fan wheel section in a simple manner.

In accordance with a further convenient feature of the invention, the compartments of the adjacently placed fan wheel sections are separated by at least one guide disk from each other and at the outer ends of the fan wheels further guide disks are provided. The guide disks make possible exact alignment of the products placed in the compartments and preclude the products of one compartment from interfering with those in the next compartment.

It is an additional advantage if each shaft has a disk carrier which is peripherally slitted and on which a peripherally slitted guide disk may be detachably secured which extends in a radial direction at least as far as the bottom of the compartment. The annular guide disks mounted on the periphery of these disk carriers may readily be detached owing to the slits therein. It is, thus, readily possible to remove one or both of the guide disks if closely adjacent webs or a web trained over a plurality of fan wheel sections are being processed. The disk carriers and accordingly the guide disks are preferably arranged so that they may be laterally adjusted so that it is possible to take into account the distance and the breadth of the respective webs to be processed.

Other objects and features of the present invention will become apparent from the following detailed description of the drawing figures which illustrate a preferred embodiment of the present invention. It should be recognized that the accompanying drawing figures are intended to illustrate but one embodiment of the present invention and are not intended as a means for defining the scope and limitations of the present invention.

BRIEF DESCRIPTION OF THE DRAWING FIGURES

In the drawing, wherein similar reference numerals denote similar features throughout the several views.

DETAILED DESCRIPTION OF THE DRAWING AND PREFERRED EMBODIMENT

Figure 1:
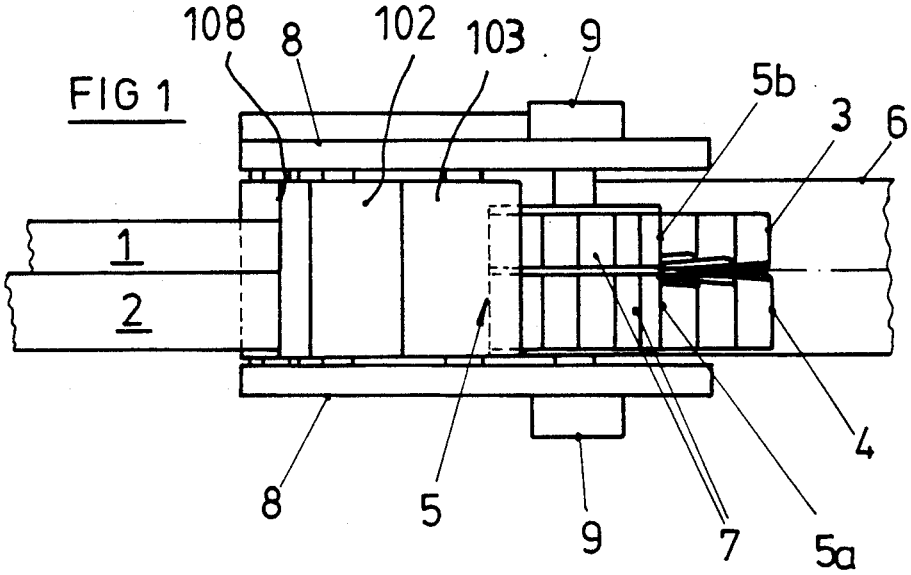
FIG. 1 is a diagrammatic plan view of a folder in accordance with the present invention.

Turning now, in detail, to an analysis fo the drawing figures, a folder apparatus is shown in FIG. 1 which has a working width wherein two adjacently moving webs 1 and 2, of standard width or one double-width web, may be processed in order to yield overlapping streams. In the present case, there is shown in FIG. 1, two overlapping streams 3 and 4, which are deposited on a delivery belt 6 running under the fan wheel 5, which extends across the full working width of the folder. The working members of the folder are, in this respect, designed so that it is possible for different types of product to be handled across the working width of the machine. It is, thus, possible, for instance, to collect products to be handled on one side of the folder and for non-collected products to be handled on the other side of it.

The fan wheel 5, provided with peripherally extending compartments 7, is divided up into sections **5*a* and 5*b* adjacent to each other in the axial direction so as to correspond to the two webs 1 and 2 supplied to the machine. The joint wherein the two sections 5*a* and 5*b* abut is, accordingly, in the middle of the folder apparatus in order to comply with the arrangement of the webs. The two sections 5*a* and 5*b* are bearinged so that they may be turned independently of each other and, accordingly, may be driven separately. Each section of the fan wheel 5 is so driven at a speed adapted to suit the type of product on the respective side of the folder apparatus that each of the peripheral compartments 7 of each section 5*a* and 5*b* are provided with drive means 9 arranged on the two outer side of the folder side walls 8** facing away from each other.

Figure 2:
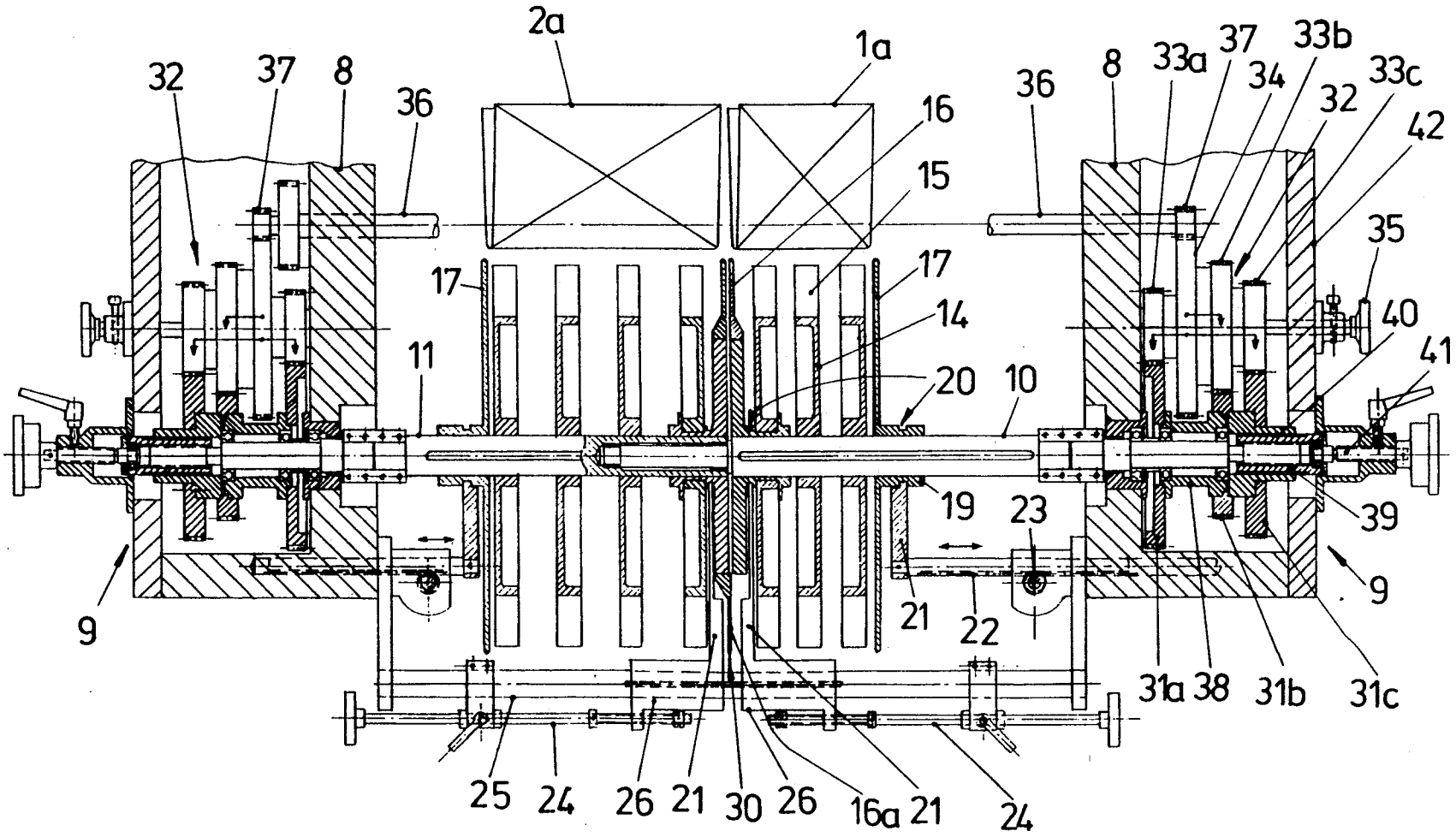
FIG. 2 is a longitudinal section taken through a fan wheel having two sections.

The fan wheel 5 which, in the present case is divided at the middle, includes, as may best be seen from FIG. 2, of two coaxially arranged shaft sections 10 and 11, whose mutually remote ends are bearinged in the side walls 8 of the folder apparatus and whose adjacent ends are bearinged on each other. These two aligned shaft sections 10 and 11 lead, in fact, to a central carrier, extending right through the full width of the folder apparatus, with separately driven sections. At the adjacent ends of the shaft sections 10 and 11, the one shaft section 11 is provided with a coaxial blind hole 12 to receive the journal pin 13 of the other shaft section 10, which extends past the junction between the two shaft sections. The depth of penetration is such that there are two mutually spaced support points formed by needle bearing ring members; this ensuring a firm construction. In order to form the peripheral compartments 7, rim-like fan carriers 14 are keyed on the shaft sections 10 and 11 forming a central carrier, and these rim-like carriers carry fan members 15 forming the walls which are to the front and rear of each compartment 7. The number of the spaced fan carriers 14 is dependent on the width of the respective webs 1 and 2 to be processed.

In the illustrated working embodiment of the invention, the web 1 and the folded products **1*a*, resulting therefrom, are narrower than the web 2 and the folded products 2*a* that it yields. Accordingly, on the fan wheel section for the web 2, there are broader compartments with more fan members than on the other fan wheel section. The fan carriers 14**, which are not needed in each specific case, may be removed.

The products **1*a* and 2*a* are laterally guided on and inserted into the compartments 7 of their respective fan wheel sections. For this purpose, the compartments are provided with lateral limiting annularly rotating inner and outer guide disks 16 and, respectively, 17. The disks 16 and 17 are mounted on disk carriers 18 and, respectively, 19 which are keyed on the associated shaft sections 10 and, respectively, 11** so as to be able to be laterally shifted and they fit around the shaft sections.

In relatively simple cases, in which the webs processed always have the same width, the guide disks 16 and 17 and, accordingly, the disk carriers 18 and 19 supporting them may be arranged so that they are not able to shift axially. In the illustrated embodiment of the present invention, in order to adapt the compartments laterally to the guide disks 16 and 17 mounted on them and laterally limited by them, the disk carriers 18 and 19 are able to be laterally shifted on the respectively associated shaft sections 10 and 11, which abut each other in order to match the respective web breadths and positions.

Adaptation to breadth is performed primarily by resetting the outer guide disks 17. The associated disk carriers 19 are, accordingly, shifted from the outermost position on the left in FIG. 2 for the broader web into the innermost position shown on the right in FIG. 2, and vice versa. The inner guide disks 16 are aligned with the breadth of the web. In order to reset the guide disks 16 and, respectively, 17, there are setting means engaging the associated disk carriers 18, respectively, 19. For this purpose, the disk carriers 18 and 19 are provided with a peripheral groove 20 in a hub-like part surrounding the associated shaft section 10 and, respectively, 11. This groove 20 receives a radial setting arm 21.

Figure 3:
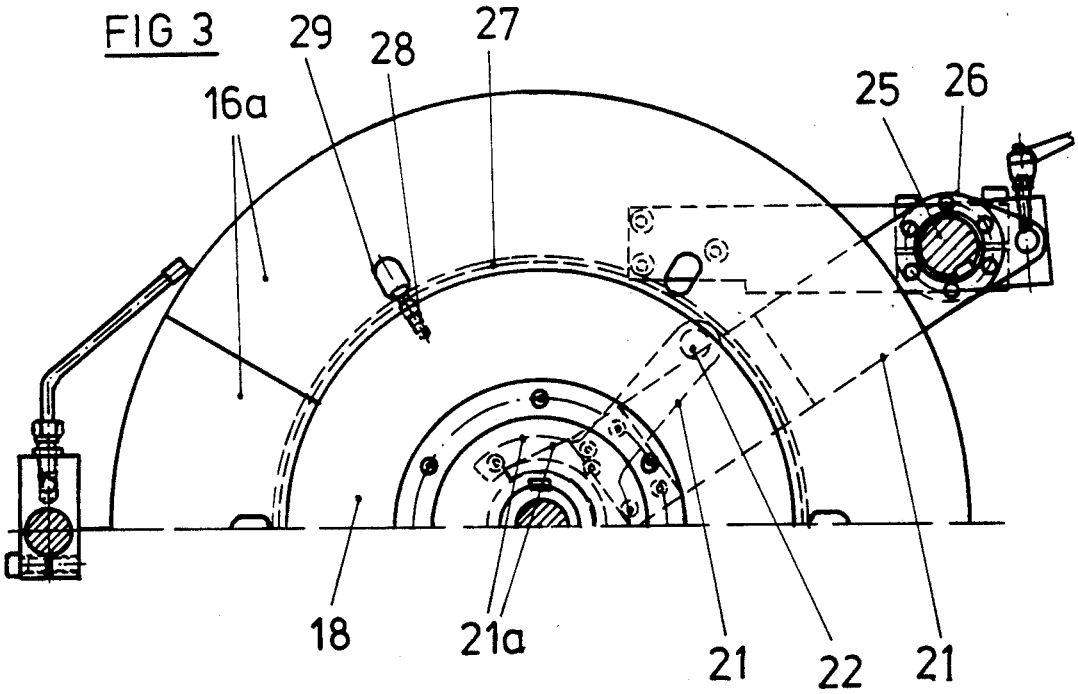
FIG. 3 is a radial section in the parts where the two sections abut each other; and, FIG. 4 is a schematic representation of a folding apparatus, as seen from a side view.

As may best be seen from FIG. 3, this setting member is preferably in the form of a fork 21*a*. The radial setting arms 21 engaging the disk carriers 19, mounted on the outer guide disks 17, are able to be moved by means of a respective rack 22 parallel to the shaft of a pinion 23 cooperating with the rack 22. The racks 22 may be arranged to run in recesses in the side walls 8 of the folder apparatus of the invention. The setting arms 21, associated with the inner guide disks 16 and which only have to be moved a small amount, are moved by lead screws 24 running parallel to the shaft and which may be mounted on a cross member 25 attached to the side walls 8 of the folder apparatus.

In the illustrated form of the invention, the setting arms 21, as well, are provided with bushings 26 bearinged on the cross member 25 so that, despite the great length of these setting arms, which have to extend past the periphery of the fan wheel, there is a firm construction. The cross member 25 is positioned in a peripheral part of the fan wheel 5, in which the compartments 7 are empty so that the insertion and removal of the products are not hindered by the setting arms 21, which extend past the periphery of the fan wheel and associated with the inner guide disks 16.

In order to ensure a reliable guiding action on the associated shaft sections 10 and 11, the disk carriers 18 and, respectively, 19 are provided with comparatively long hub members surrounding the shaft sections. On the hub member of the inner disk carriers 18 there is, in each case, a respective fan carrier 14 so that there is a comparatively small distance between the inner fan members 15 from the adjacent inner guide disks 16. The disk carriers 19, associated with the outer guide disks 17, overlap the guide disks 17 outwardly so that the latter may be arranged near enough to a fan carrier 14 mounted on the associated shaft section 10 or, respectively, 11.

The outer guide disks 17 are molded on the associated hub-like disk carriers 18. The inner guide disks 16 include, as may best be seen from FIG. 3, segments 16*a* which are able to be detachably mounted on the associated disk carriers 18. At their radially inner edge, these segments are provided with a broader part 27 forming a foot; such broader part being able to engage the periphery of generally equally broad disk carrier 18 and screwed to it by screws 28, which are locked so that they are retained when unscrewed. For this purpose, the radially arranged screws 28 are so placed that their heads fit into a radial recess 29 provided in the associated segment 16*a*, the radial length of the recess 29 being less than the length of the screw. The possibility of removing the inner guide disks 16 makes possible adaptation of the inner limit of each compartment to suit any web spacing and the production of compartments extending right across the width of the fan wheel without any interruption.

If the webs 1 and 2, to be processed, have a clearance between them, the inner disk carriers 18 mounted on the two shaft sections 10 and 11 are fitted with a guide disk 16, as will be seen and indicated in the upper half of the fan wheel shown in FIG. 2. The wheel carriers 18 are then generally symmetrical with respect to the joint. If the webs to be processed adjacent to each other do not have any noticeable distance between them, only one of the two inner disk carriers 18 is fitted with an annular guide disk 16*a* having segments, as is indicated in the lower part of FIG. 2. This one guide disk is then positioned exactly in the middle, that is to say exactly on the joint; something that may be achieved by suitable lateral resetting of the disk carrier 18. The radially outer edge of the guide disk 16 is outwardly tapered to form ramp surfaces 30 for the products running into the fan wheel. The inactive disk carrier 18 comes to an end radially within the bottom of the compartment and, thus, does not cause any interference. If in place of two adjacently running webs, a web with a double width is processed, all of the inner guide disks 16 are removed so that there are continuous, non-divided compartments extending over the full width of the fan members. In this case, the two fan wheel sections 5*a* and 5*b* are driven synchronously and thus function as a single non-divided fan wheel.

The lateral drive means 9 secured to the shaft sections 10 and 11 each comprise, as may also be seen from FIG. 2, a set of wheels with a plurality of drive wheels 31*a*, 31*b* and 31*c* connected with the associated shaft section 10 and 11. The wheel set comprising the drive wheels 31*a*, 31*b* and 31*c* is provided with multi-speed gearing 32 with the output wheels 33*a*, 33*b* and 33*c* in mesh with the drive wheels 31*a*, 31*b* and 31*c* and the output wheels may be selectively coupled with an input wheel 34. For this purpose, the multi-speed gearing 32 is provided with a coupling element coaxially arranged in relation to the wheels and able to be reset by means of a handle 35. The output wheel 33*a*, 33*b* or, respectively, 33*c* coupled by this coupling element is driven. Owing to their engagement with the respectively associated drive wheel of the wheel set on the shaft side, the other output wheels are entrained as well. The input wheels 34 of the two lateral multi-speed gearing units 32 are driven at the same speed by means of a drive pinion 37 mounted on the drive shaft 36 extending for the full width of the machine.

The sections 5*a* and 5*b* arranged alongside each other of the fan wheel are able to be moved forwards and backwards in the direction of rotation for adjustment in order to set their peripheral position in accordance with the weight of the folded products to be carried. For this purpose, the drive wheels 31*a*, 31*b* and 31*c* are mounted on a carrier 38 including the associated shaft section. This carrier is in mesh with a bushing 40 via helical gearing 39. The bushing 40 is keyed on the associated shaft section 10 and 11 and is able to be shifted axially by means of a drive lead screw 41 in engagement with it. There are boxes 42 on the side walls of the folder apparatus to receive the drive means 9.

Figure 4:
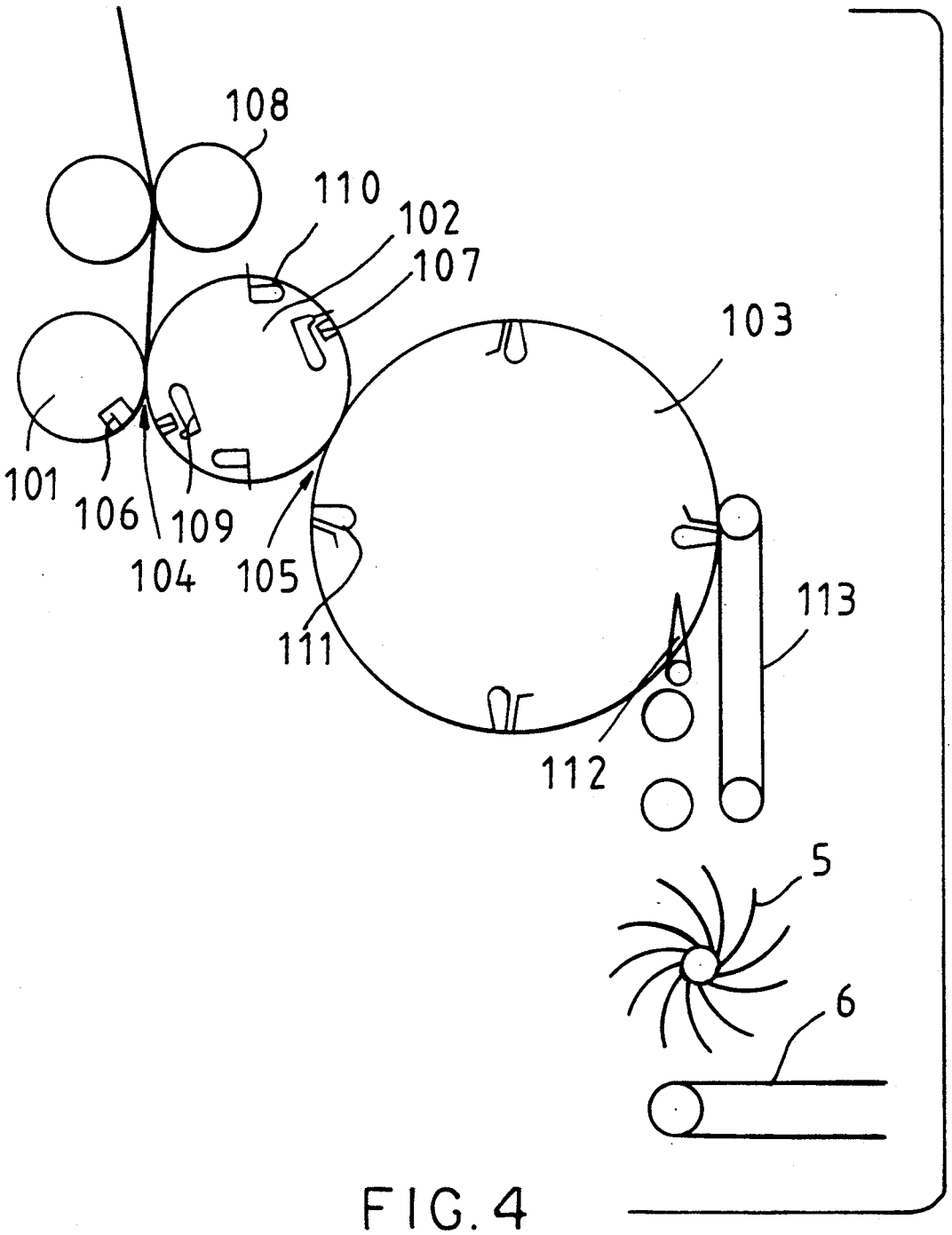

FIG. 4 presents a schematic representation of a folding apparatus. The folding apparatus is represented as including three cylinders 101, 102, 103, which are constructed and arranged so that a cutting slit 104 and a folding slit 105 are formed (see, also, FIG. 1.) Cutting devices 106, 107 of cylinders 101, 102 operate together, in the region of cutting slit 104, in such a way that the web material inserted in cutting slit 104 by tensioning rolls 108 is divided into sheet-shaped sections. The front end of these sections is held by puncturing needles 109 of cylinder 102.

The folding apparatus, in the form of folding knife 110 of cylinder 102 and folding flaps of cylinder 103, work together, in the region of folding slit 105. In this fashion, the sheet-shaped sections are transferred to cylinder 103 with the formation of a transverse fold. From cylinder 103, the products provided with a traverse fold are removed by means of a lift-off device 112, and conveyed to fan wheel 5 by means of a conveyor belt 113. The products are then peeled away by fan wheel 5 onto carrier belt 6. Fan wheel 5 is constructed in accordance with the present invention.

While only several embodiments of the present invention have been shown and described, it will be obvious to those of ordinary skill in the art that many modifications may be made to the present invention without departing from the spirit and scope thereof.

What is claimed is:

1. A folder apparatus for processing at least two webs running adjacent to each other, comprising a cutting cylinder for cutting the webs into discrete lengths, folding cylinders for folding the discrete lengths, and at least one fan wheel which includes lateral guide disks delimiting peripherally arranged compartments in the fan wheel, said fan wheel being subdivided into a number of laterally adjoining fan wheel sections, whose number is equal to the number of webs to be processed, and having drive means for separately driving the fan wheel sections.

2. The folder apparatus as claimed in claim 1, wherein the laterally adjoining fan wheel sections have associated shaft sections fitting one within the other at a joint between them and have remote ends cooperating with the drive means and bearinged in side walls of the folder apparatus.

3. The folder apparatus as claimed in claim 2, wherein one of the shaft sections has a coaxial hole receiving a journal pin on an adjoining shaft section.

4. The folder apparatus as claimed in claim 2, wherein the lateral drive means each comprise a plurality of drive wheels drivingly connected with the associated shaft section and having different diameters, such drive wheels cooperating with associated output wheels of a multi-speed gearing unit comprising an input wheel able to be alternatively coupled therewith.

5. The folder apparatus as claimed in claim 4, wherein the input wheels of the multi-speed gearing unit are able to be driven by a drive shaft extending across the full width of the folder apparatus.

6. The folder apparatus as claimed in claim 4, wherein the drive wheels are mounted on a carrier surrounding the associated shaft section coupled by a helical gearing with a bushing keyed on the associated shaft section so as to be axially movable thereon.

7. The folder apparatus as claimed in claim 4, wherein each of said associated shaft sections, arranged at a joint formed between two of said associated shaft sections, has a disk carrier comprising a guide disk detachably secureable to said disk carrier.

8. The folder apparatus as claimed in claim 7, wherein adjacent disk carriers, arranged at the joint between two associated shaft sections, and guide disks have stepless adjacent surfaces which are parallel to each other.

9. The folder apparatus as claimed in claim 7, wherein one of said disk carriers is fitted with single guide disk which has an outwardly tapered rim.

10. The folder apparatus as claimed in claim 7, wherein said disk carriers each have a hub-like holder for a rimlike fan carrier at mutually remote sides of the disk carriers.

11. The folder apparatus as claimed in claim 10, comprising entraining means in the form of a fork fitting into a peripheral groove which is associated with the disk carriers on which it is mounted on a hub part on the associated shaft section.

12. The folder apparatus as claimed in claim 11, wherein the entraining means engaging the disk carriers, on which they are mounted, are able to be operated by a rack arranged parallel to the associated shaft section and able to be driven by a pinion.

13. The folder apparatus as claimed in claim 11, wherein the entraining means engaging guide or disk carriers, on which they are mounted, each have a bushing mounted on a cross member and are able to be shifted by means of a lead screw mounted on the cross member.

14. The folder apparatus as claimed in claim 2, wherein the associated shaft sections are detachably secured to fan member carriers and are provided with fan members.

15. The folder apparatus as claimed in claim 1, wherein the laterally adjoining fan wheel sections are provided with guide disks delimiting their compartments laterally.

* * * * *